US009885211B2

(12) United States Patent
Parker

(10) Patent No.: US 9,885,211 B2
(45) Date of Patent: Feb. 6, 2018

(54) DOOR SEAL

(71) Applicant: RBP Associates Limited, Hampshire (GB)

(72) Inventor: Ronald Brian Parker, Hampshire (GB)

(73) Assignee: RBP ASSOCIATES LIMITED, Hampshire (GB)

( * ) Notice: Subject to any disclaimer, the term of this patent is extended or adjusted under 35 U.S.C. 154(b) by 0 days.

(21) Appl. No.: 14/425,270

(22) PCT Filed: Aug. 30, 2013

(86) PCT No.: PCT/GB2013/000365
§ 371 (c)(1),
(2) Date: Mar. 2, 2015

(87) PCT Pub. No.: WO2014/033424
PCT Pub. Date: Mar. 6, 2014

(65) Prior Publication Data

US 2015/0233175 A1 Aug. 20, 2015

(30) Foreign Application Priority Data

Aug. 30, 2012 (GB) ..... 1215433.2

(51) Int. Cl.
*E06B 7/215* (2006.01)
*E06B 7/21* (2006.01)
(Continued)

(52) U.S. Cl.
CPC ..... *E06B 7/215* (2013.01); *E06B 7/18* (2013.01); *E06B 7/20* (2013.01); *E06B 7/21* (2013.01)

(58) Field of Classification Search
CPC ... E06B 7/215; E06B 7/21; E06B 7/18; E06B 7/20
See application file for complete search history.

(56) References Cited

U.S. PATENT DOCUMENTS 1,682,389 A 8/1928 Ludeke
1,709,419 A 4/1929 Sward
(Continued)

FOREIGN PATENT DOCUMENTS

CH 666719 A5 8/1988
DE 3109105 A1 9/1982
(Continued)

OTHER PUBLICATIONS

International Search Report dated Nov. 18, 2013 for corresponding International Application No. PCT/GB2013/000365, filed Aug. 30, 2013.
(Continued)

*Primary Examiner* — Gregory Strimbu
(74) *Attorney, Agent, or Firm* — David D. Brush; Westman, Chmaplin & Koehler, P.A.

(57) ABSTRACT

A sealing assembly for a hinged door is pivotable over a door threshold when the door is opened or closed. The sealing assembly includes an actuator responsive to closing of the door, the actuator having at least one connector rod extending along a channel and being movable longitudinally within the channel in response to the door closing. The rod is connected to a first end of at least one pivotable arm having rigid sections separated by flexible joints, with a second end of the arm being connected to a sealing member. The arm is flexible such that as the connector rod moves along the channel, part of the arm flexes vertically thereby imparting and maintaining vertical pressure on the sealing member.

4 Claims, 8 Drawing Sheets

(51) Int. Cl.
*E06B 7/18* (2006.01)
*E06B 7/20* (2006.01)

(56) References Cited

U.S. PATENT DOCUMENTS

| | | | | |
|---|---|---|---|---|
| 1,948,108 | A | | 2/1934 | Goellner |
| 2,066,188 | A | | 12/1936 | Reese |
| 2,282,019 | A | | 5/1942 | Balousek |
| 2,344,278 | A | | 3/1944 | Balousek |
| 2,820,261 | A | | 1/1958 | Brown |
| 3,030,674 | A | | 4/1962 | Kapaun et al. |
| 3,072,977 | A | | 1/1963 | Burda |
| 3,199,155 | A | | 8/1965 | Coleman |
| 3,703,788 | A | | 11/1972 | Rivers |
| 3,704,547 | A | | 12/1972 | Hansen et al. |
| 4,089,136 | A | | 5/1978 | Lapinski et al. |
| 4,406,088 | A | | 9/1983 | Berndt, Jr. |
| 4,425,738 | A | | 1/1984 | Christensen |
| 4,519,165 | A | | 5/1985 | Cronenberg et al. |
| 4,614,060 | A | * | 9/1986 | Dumenil ..... E06B 7/215 49/303 |
| 4,805,345 | A | | 2/1989 | Ohi |
| 4,947,584 | A | | 8/1990 | Wexler |
| 5,454,192 | A | | 10/1995 | Adler et al. |
| 5,522,180 | A | | 6/1996 | Adler et al. |
| 5,942,588 | A | | 8/1999 | Ettl et al. |
| 6,082,047 | A | | 7/2000 | Comaglio et al. |
| 6,125,584 | A | | 10/2000 | Sanders |
| 6,195,939 | B1 | | 3/2001 | Sowers |
| 6,332,294 | B1 | | 12/2001 | Carranza |
| 7,260,915 | B2 | | 8/2007 | Cronenberg et al. |
| 8,925,250 | B2 | | 1/2015 | Parker |
| 2004/0010973 | A1 | | 1/2004 | Lio et al. |
| 2009/0077895 | A1 | | 3/2009 | Tshai |

FOREIGN PATENT DOCUMENTS

| | | | | |
|---|---|---|---|---|
| DE | 3124106 | A1 | | 12/1982 |
| DE | 35 26 720 | | * | 1/1986 |
| DE | 3526720 | A1 | | 1/1986 |
| EP | 0844359 | A2 | | 5/1998 |
| EP | 1450002 | A1 | | 8/2004 |
| EP | 1 717 405 | | * | 11/2006 |
| EP | 2 474 698 | | * | 7/2012 |
| WO | 2012032295 | A1 | | 3/2012 |

OTHER PUBLICATIONS

Written Opinion dated Nov. 18, 2013 for corresponding International Application No. PCT/GB2013/000365, filed Aug. 30, 2013.

* cited by examiner

DOOR SEAL

CROSS-REFERENCE TO RELATED APPLICATIONS

This Application is a Section 371 National Stage Application of International Application No. PCT/GB2013/000365, filed Aug. 30, 2013 the content of which is incorporated herein by reference in its entirety, and published as WO 2014/033424 on Mar. 6, 2014, in English.

FIELD OF THE DISCLOSURE

The present invention relates to a door seal and more especially to an improved automatic door seal that acts to seal the gap between the door and its threshold on closure of the door.

BACKGROUND OF THE DISCLOSURE

An automatic drop-down door seal developed by the Applicant is disclosed in WO2012/032295. The present invention relates to improvements to the door seal disclosed therein and specifically to provide an improved mechanism to impart a continual vertical pressure on the seal housing during use to retain the seal firmly against the adjacent surface in use.

SUMMARY

A first aspect of the invention provides a sealing assembly for a hinged door which is pivotable over a door threshold when closed, the sealing assembly comprising a plurality of elements located within a channel positionable adjacent an edge of the door, the elements comprising an actuator responsive to closing of the door, the actuator comprising at least one connector rod extending along the channel and being movable longitudinally within the channel in response to the door closing, the or each rod being connected to at least one pivotable arm comprising rigid sections divided by flexible joints, the other end of the arm being connected to a sealing member, the or each arm being flexible such that as the or each connector rod moves along the channel part of the arm flexes vertically thereby imparting and maintaining vertical pressure on the sealing member during use.

The or each arm may comprise at least one rigid section that comprises a recessed groove shaped so as to receive and retain a curved connector rod, which rod extends beyond the arm and is connected to a second arm.

The connector rod may be connected to the second arm by means of a first connector block which is connected to a further connector rod which is attached to the second arm.

The assembly may further comprise a spring member that is connected to the sealing member at one part thereof and to a second connector block at a second part thereof, which second connector block is fixed in position within the channel, the spring member being configured to pull or push the sealing member back when the actuator is deactivated.

The spring member may be a leaf-type spring member, substantially planar in profile.

The second connector block may comprise a recessed groove through which the connector rod passes between the first and second arms.

The or each arm may comprise first, second and third rigid sections divided by first and second flexible joints, the first rigid section being connected to the actuator and the third rigid section being connected to the sealing member.

Each rigid section of the arm may be formed of polypropylene.

The or each flexible section of the arm may be formed of TPE.

The or each flexible TPE section may be selected so as to melt in the presence of heat associated with a fire so as to substantially fuse and fix the arm in its current state.

A second aspect of the invention provides a sealing assembly for a hinged door which is pivotable over a door threshold when closed, the sealing assembly comprising: a plurality of elements located within a channel positionable adjacent an edge of the door, the elements comprising an actuator which mechanically moves responsive to closing of the door, the actuator comprising a first connector rod extending along the channel and being movable longitudinally within the channel, the first connector rod being connected to a drop arm comprising first, second and third substantially rigid sections divided by first and second flexible joints, the first rigid section being connected to the first connector rod and the third rigid section being connected to a sealing member, the drop arm being configured to flex at one or both flexible joint(s) as the first connector rod moves along the channel in order to impart and maintain a vertical force on the sealing member in use, and wherein a spring member is provided which is connected to the sealing member at one part thereof and to a fixed connector block within the channel at another part thereof in such a way as to pull/push the sealing member backwards into the channel when the actuator is deactivated.

A further aspect of the invention provides a sealing assembly for a hinged door which is pivotable over a door threshold when closed, the sealing assembly comprising a plurality of elements located within a channel positionable adjacent an edge of the door, the elements comprising an actuator responsive to closing of the door, the actuator comprising at least one connector rod extending along the channel and being movable longitudinally within the channel in response to the door closing, the or each rod being connected to at least one pivotable arm comprising rigid sections divided by flexible joints, the other end of the arm being connected to a sealing member, the or each arm being flexible as the or each connector rod moves along the channel to a position whereby the part of the arm flexes vertically thereby imparting and maintaining vertical pressure on the sealing member during use.

BRIEF DESCRIPTION OF THE DRAWINGS

Embodiments of the invention will now be described with reference to the accompanying figures in which.

DETAILED DESCRIPTION OF ILLUSTRATIVE EMBODIMENTS

The main elements of a drop-down seal are shown and described in WO2012/032295, corresponding to U.S. Pat. No. 8,925,250, the contents of which are hereby incorporated by reference.

The foregoing description will only discuss the improvements to such a system.

Figure 1:
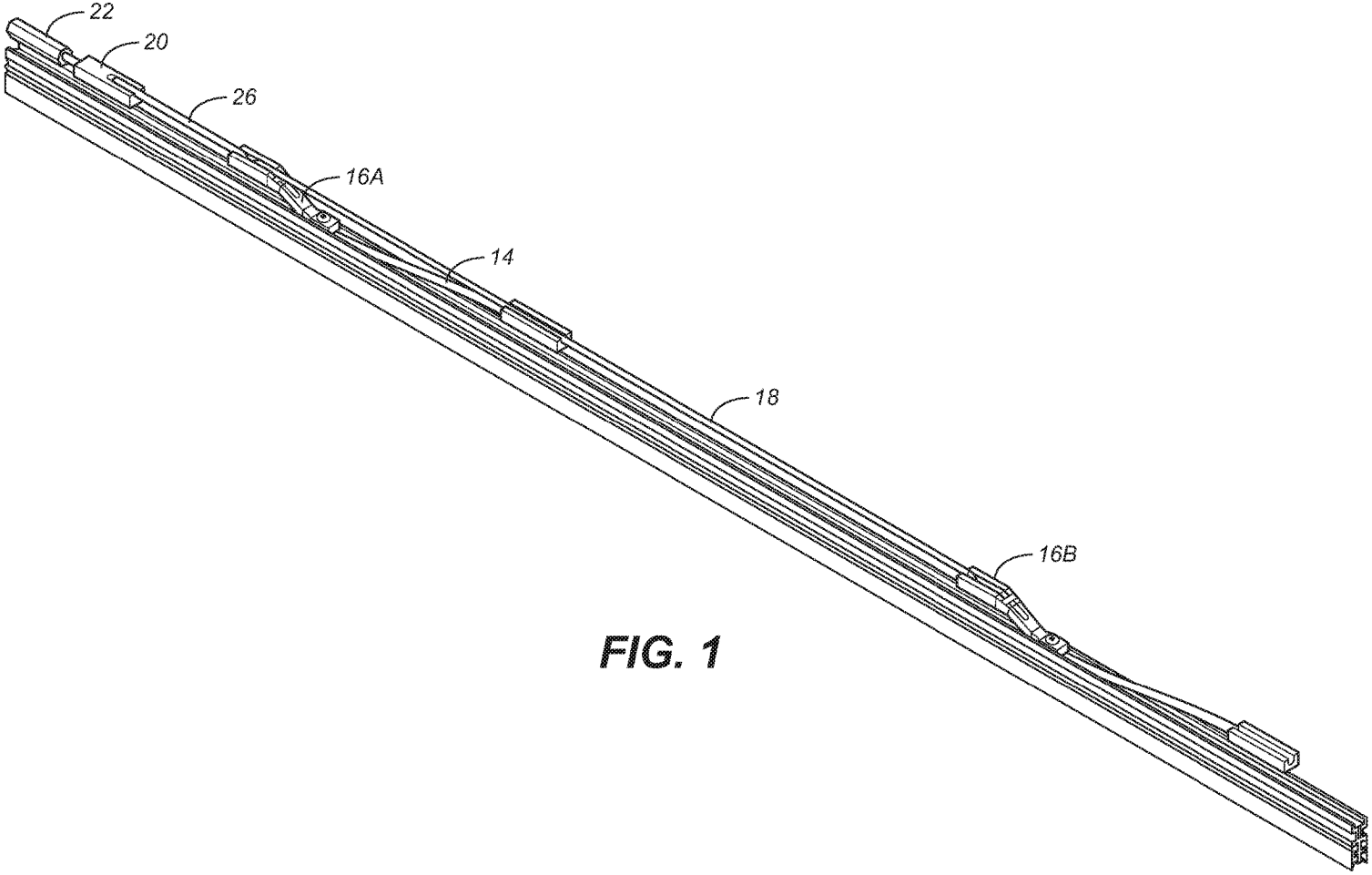
FIG. 1 is a perspective view of a door seal in accordance with the invention.
Figure 2:
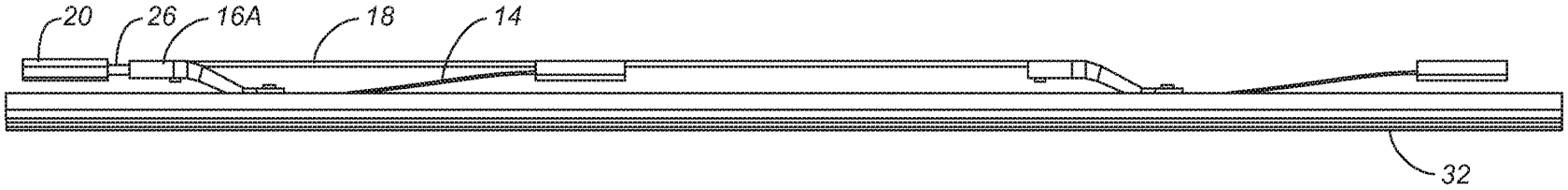
FIG. 2 is a side view of the assembly of FIG. 1.

FIGS. 1 and 2 show a door seal constructed in accordance with a first embodiment of the invention.

The seal mechanism comprises a main housing 10 (see FIGS. 12 and 13) which is locatable on the edge of a door (not shown) or which may be located within a recess formed in the edge of a door.

It has been found, for reasons explained later, that the seal mechanism is suitable for location on the top, as well as the bottom, of a door (as is traditional) or within a recess formed in the top or bottom of the door.

The main housing 10 may alternatively be fixed to the back of the door bottom or top.

The housing 10 is formed as an inverted U-shaped section and defines a longitudinal channel 12.

Referring to FIGS. 1 and 2, extending through the housing 10 is a spring mechanism designed to impart a vertical force to a sealing member 32 on depression of an actuation button 22 that occurs when a door carrying the seal mechanism is closed.

The spring mechanism comprises an assembly of spring members 14, first and second drop arms 16A, 16B and connecting rods 18. The term "drop down" has been used throughout the description for convenience and ease of understanding as it is anticipated that the most common use will be in respect of sealing at the bottom of the door. No connotation should be implied by the term "drop" as the embodiment may be used in such a way that the arm extends upward in use.

Figure 12:
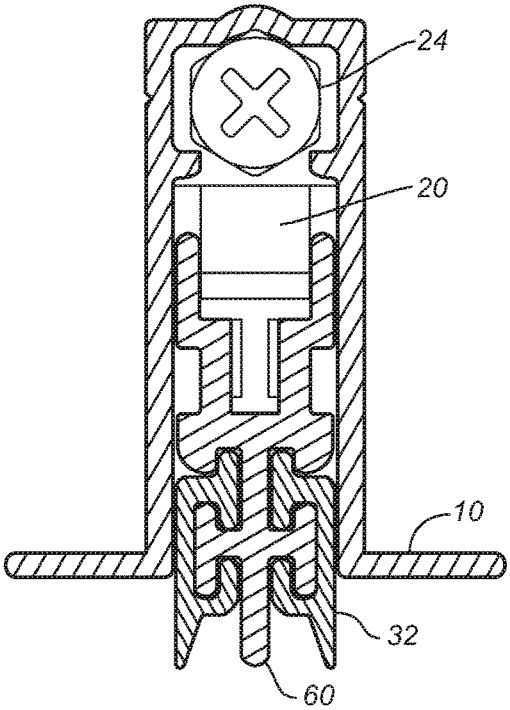
FIG. 12 is an end sectional view of the door seal assembly of FIG. 1.

Referring to FIG. 1 and FIG. 12, a first slide block 20 is located at one end of the housing 10. The block 20 is connected to the actuator button 22 which activates when the door closes, to slide the block 20 along the channel 12.

Figure 4:
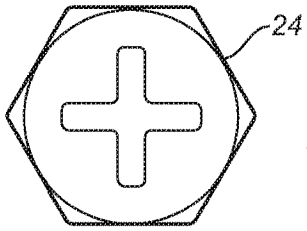
FIG. 4 is an end view of the cap nut of FIG. 3.
Figure 3:
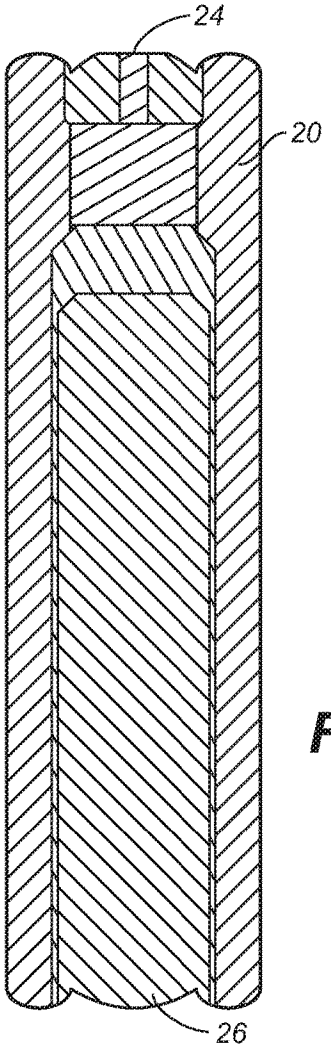
FIG. 3 is side sectional view of a cap nut of the spring assembly of FIG. 1.

A longitudinal cross section of the slide block 20 can be seen in FIG. 3. The slide block 20 is connected to the actuator button 22 via an adjustable hexagonal cap nut 24, shown from one end in FIG. 4.

The other end of the block 20, remote from the actuator button, is attached via a plunger rod 26 to the first drop arm 16A.

Figure 5:
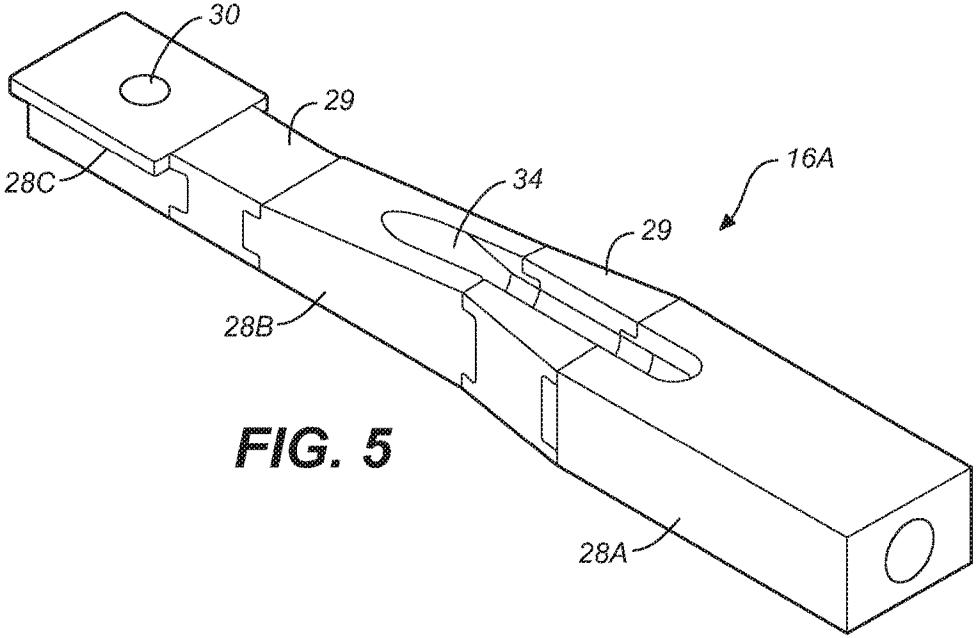
FIG. 5 is a perspective view of a drop arm of the spring assembly of FIG. 1.
Figure 6:
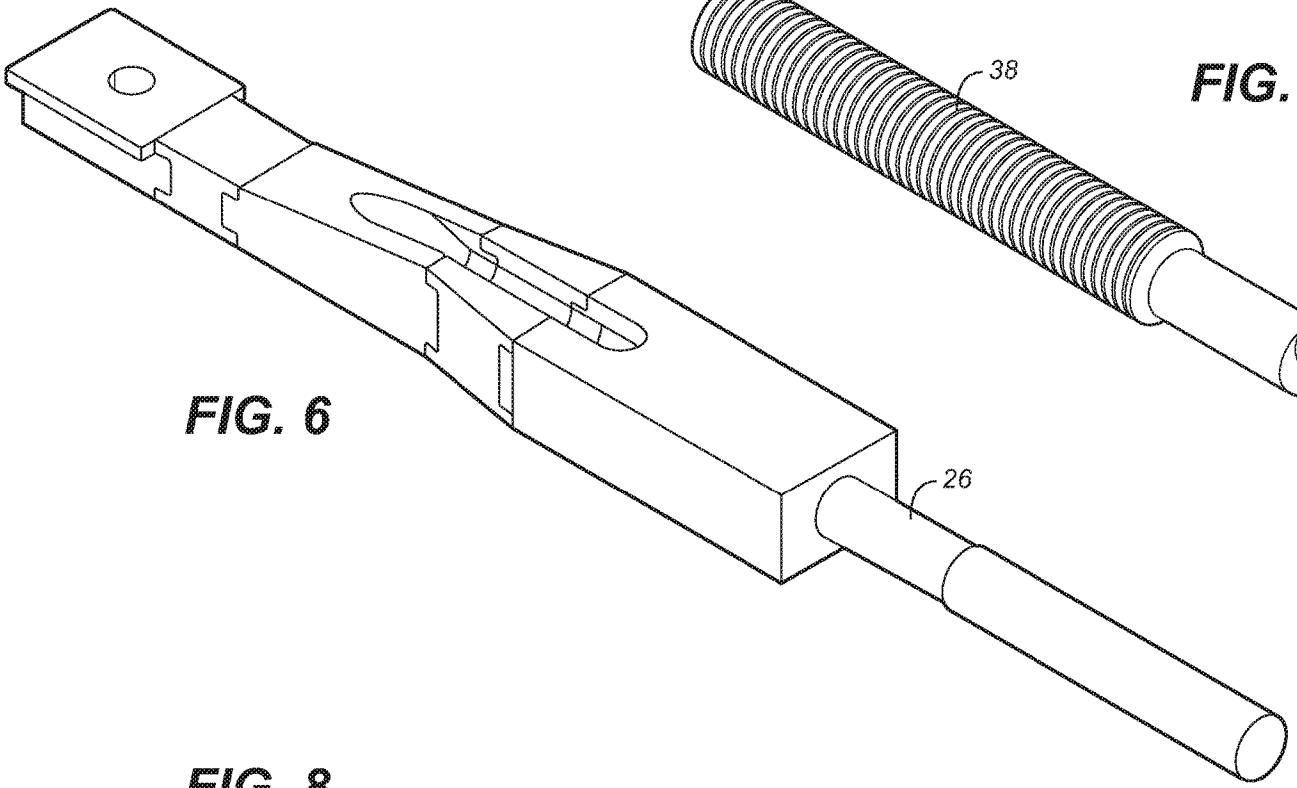
FIG. 6 is perspective view of the drop arm of FIG. 5 with a threaded push rod attached thereto.

The first drop arm 16A is shown more clearly in FIGS. 5 and 6 (FIG. 6 showing the plunger rod 26 connected to the arm 16A). The arm 16A comprises three main sections 28A, 28B, 28C made from rigid polypropylene separated by sections 29 made from flexible Thermoplastic Elastomer (TPE) to provide a rigid arm with, in this case, two flexible joints 29.

The first rigid section 28A of the arm 16A includes an end-aperture to receive one end of the plunger rod 26 (to allow movement to be imparted to the arm 16A). The third section 28C of the arm 16A has an aperture 30 to receive fastening means for securing that end 28C of the arm 16A to a sealing member 32 of the assembly.

A recessed groove 34 extends through part of the first and second rigid parts 28A,B to receive a lead rod 36.

Figure 7:
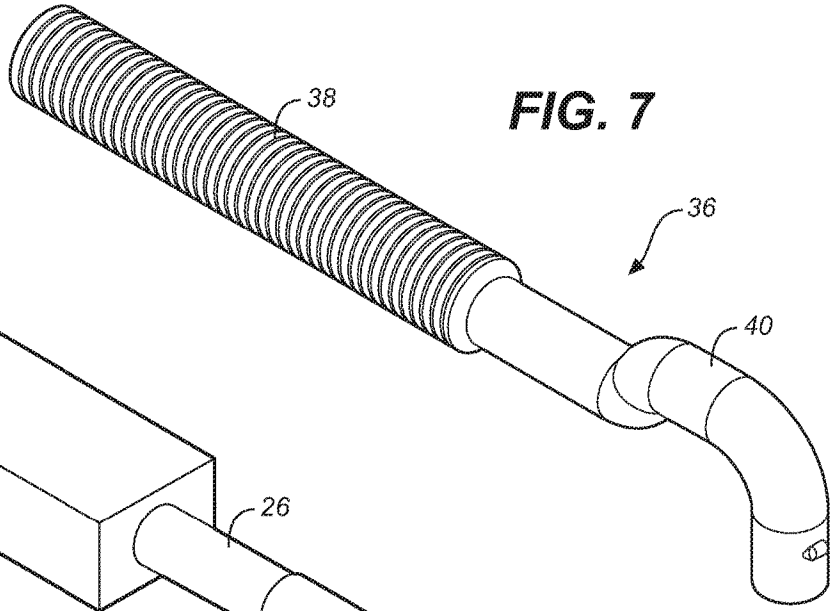
FIG. 7 is a perspective view of lead rod to connect connector rods within the assembly of FIG. 1.
Figure 8:
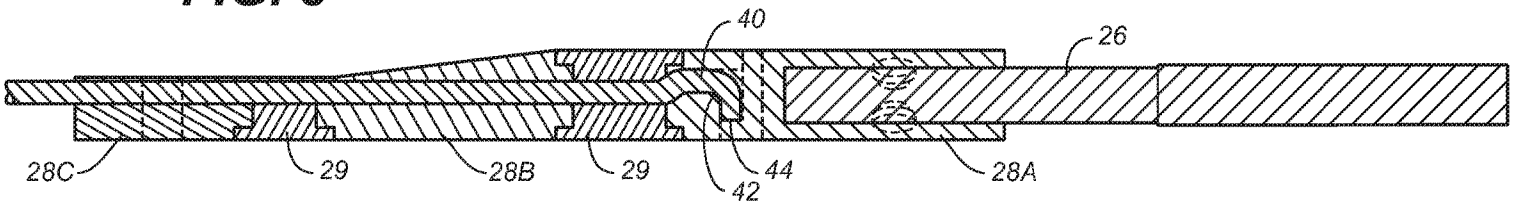
FIG. 8 is a side cross section view of the drop arm and lead rod in connection.

The lead rod 36 is shown in FIG. 7. The rod 36 comprises an elongate threaded portion 38 and a curved portion 40, which terminates with a generally U-shaped section. As can be seen in FIG. 8, the curved part 40 of the rod 36 extends into the groove 34 of the arm 16A and the tip extends between a gap 42 formed in the first section 28A of the arm 16A and against an abutment surface 44 to prevent the tip of the rod 36 from being accidentally extracted from the groove 34.

The threaded part 38 of the rod 36 receives a complimentary threaded part of a stainless steel connector rod 18. The connector rod 18 then extends further into the housing channel (as will be described later).

As movement is imparted to the arm 16A by the actuation button (left to right shown when referencing FIG. 2), the second section 28B of the arm 16A flexes downwardly (upwardly if the seal is used in the top of the door) due to the fact that the third section 28C remains in a fixed position secured to the sealing member 32. The rigidity of the main sections 28A, 28B, 28C of the arm 16A causes movement of the arm 16A to impart a vertical force to the sealing member 32. A tipping point is reached at which state the vertical movement occurs.

As can be seen in FIG. 2, the first connector rod 18 extends beyond the first drop arm 16A and through a recessed groove 48 formed in a fixed connector block 50 (see FIG. 9) which is fixed in position within the channel 12 of housing 10 and provides a first spring assembly through connection to a spring member 14 that extends back from the connector block 50 to the sealing member 32 to which it is secured.

The spring member 14 acts to pull/push the sealing member 32 back into the housing 10 once the actuator button is deactivated (i.e. un-depressed) which happens when the door is opened. When closed again, the actuator button causes the arm 16A to flex downwardly (as described above) which acts against the spring to force the sealing member 32 down.

Connector rods 18 extend through the channel 12 within the housing 10 all the way to a second drop arm 16B, as shown in FIGS. 1 and 2, which in the same way as the first drop arm 16A impart vertical force on the sealing member 32 at the location of the second drop arm 16B as well as on the first 16A. A plurality of connecting rods 18 are interconnected through the assembly via rigid polypropylene connector blocks 54 (see FIG. 10). In the case of the embodiment shown in FIGS. 1 and 2, a first connector rod extends from the first drop arm 16A to the connector block 54 and a second connector rod extends from the connector block to the second drop arm 16B.

Figures 9, 10, 11:
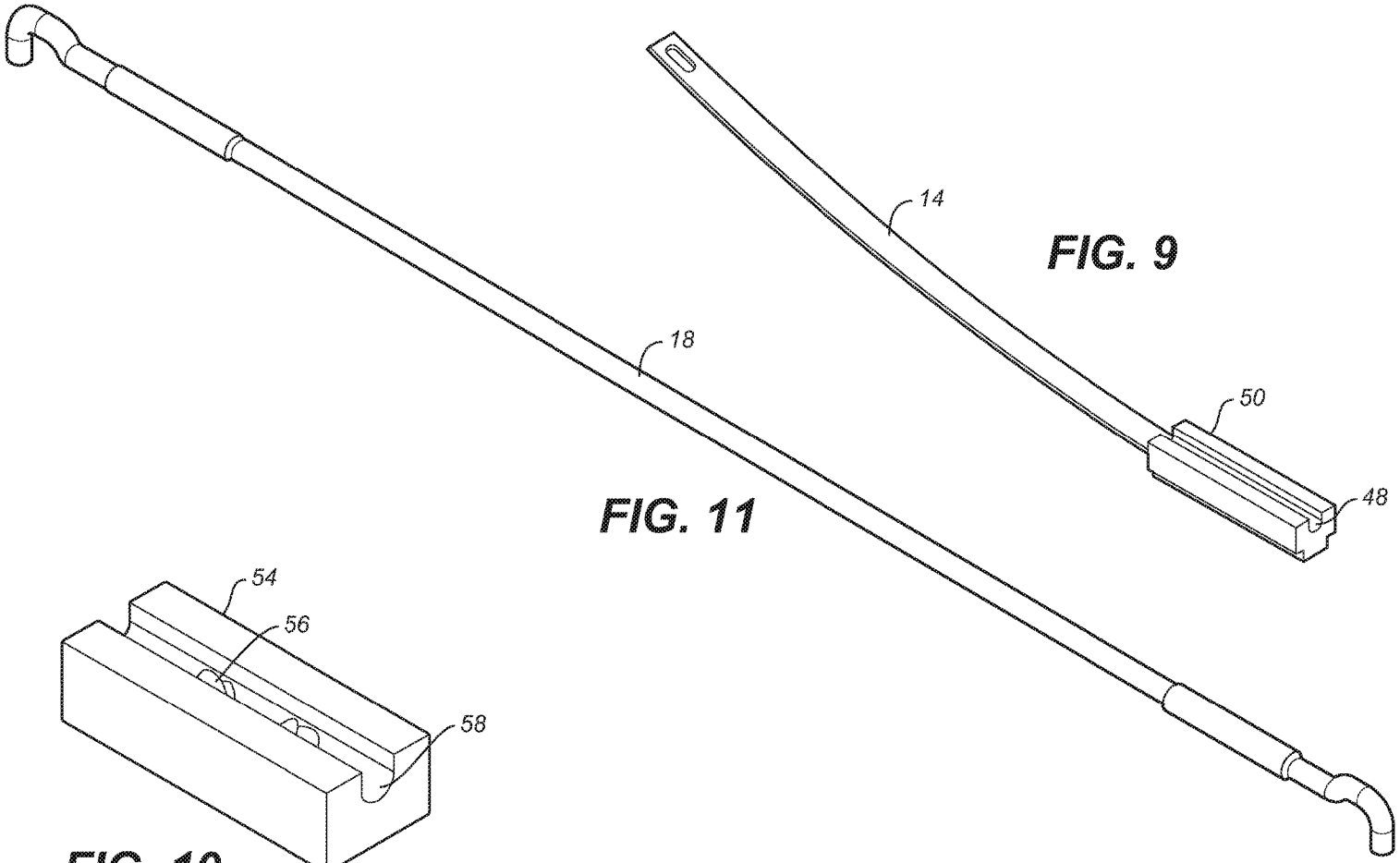
FIG. 9 is a perspective view of the spring part of the assembly of FIG. 1.
FIG. 10 is a perspective view of a connector block for connector rods of the assembly of FIG. 1.
FIG. 11 is a perspective view of a connector rod.

To this end, as can be seen in FIGS. 10 and 11 the ends of the connector rods 18 are curved so to be received within apertures in recessed grooves 58 formed along the connector block 54 allowing two connector rods 18 to be received into the connector block 54 at either end so to maintain longitudinal movement throughout the assembly of connector rods 18 all the way to the second drop arm 16B.

FIGS. 12 to 15 show end views, in cross section, of the sealing assembly.

Figure 13:
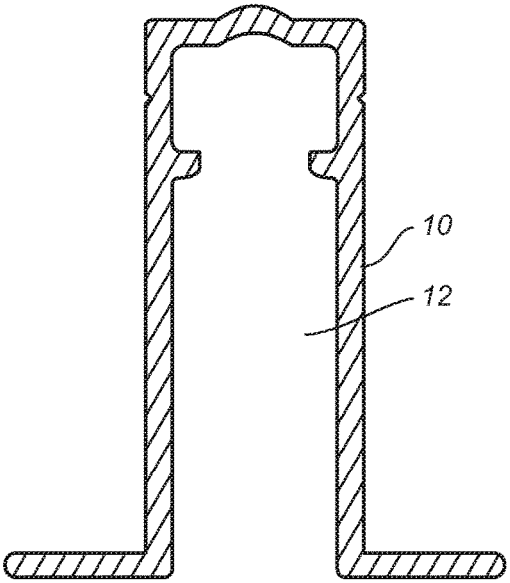
FIG. 13 is an end sectional view of the casing of the seal mechanism of FIG. 12.
Figure 14:
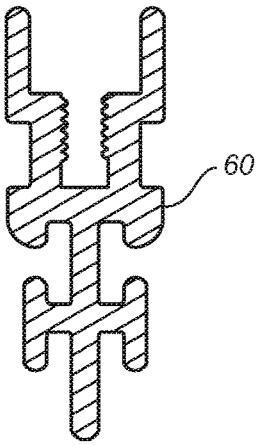
FIG. 14 is an end sectional view of drop bar of the seal mechanism of FIG. 12.

FIG. 13 shows the profile of the housing 10. FIG. 14 illustrates the aluminium drop bar element 60 of the assembly.

Figure 15:
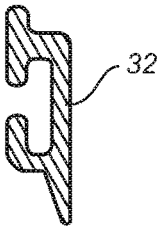
FIG. 15 is an end sectional view of a seal insert of the seal mechanism of FIG. 12.

FIG. 15 shows the sealing member 32 in the form of an EPDM (Ethylene-propylene-diene or Ethylene-propylene) insert. It will be appreciated that any other suitable rubber or rubber like material or non-rubber like material, e.g. aluminium, may be used for the seal, and in various shapes The vertical force exerted on the drop bar element 60 and hence the seal member 32 by the flexing of each drop arm 16A, 16B is sufficient to push and retain the sealing member 32 against the adjacent surface to provide an effective acoustic seal around that edge of the door. Unlike prior common place drop-down seals, the seal assembly of the present invention does not rely on gravity to extend downwardly across the gap between the door edge and the floor. Rather, a vertical force is exerted by movement of the arms 16A, 16B on closure of the door. As such, the seal assembly of the present invention would be just as applicable as, for example, use in the top edge of the door whereby flexing of the arms 16A, 16B imparts a vertical upward movement against the door threshold.

Figure 16:
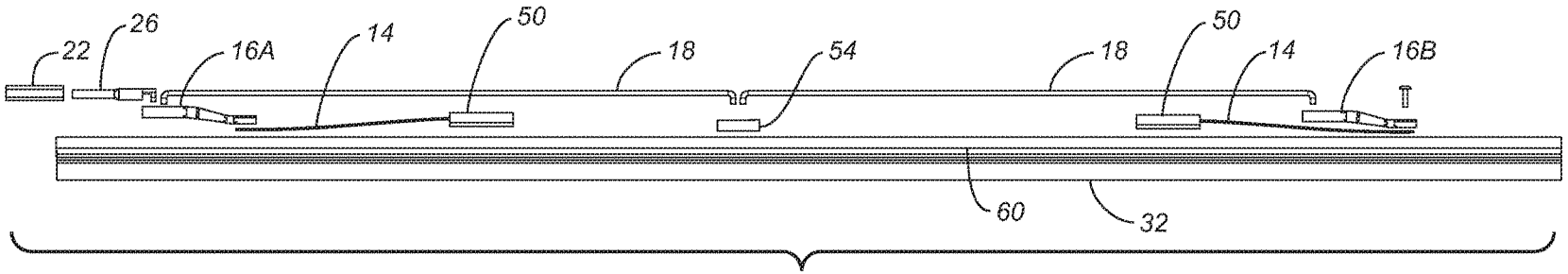
FIG. 16 is an exploded view of a second embodiment door seal in accordance with the invention.

FIG. 16 is an exploded view of a second embodiment door seal in accordance with the invention, which may also be useful for understanding the arrangement of components for the first embodiment. Related components between the first and second embodiments are shown with like reference numerals.

In the case of both embodiments, the flexible sections 29 of the drop arms 16A, 16B are made from a TPE material advantageously selected so that it will melt in the event of a fire thereby fusing the rigid sections in their current position. Therefore, if the sealing member 32 is extended vertically with pressure being applied by the drop arms 16A, 16B, that position will be maintained by the fusing of the drop arms' flexible sections 29 due to the heat of the fire thereby providing resistance to smoke and heat.

The drop arms 16A, 16B can be injection moulded as a single piece assembly. The TPE joint connections allow the arm sections to bend while being extremely robust, making them difficult to tear or rip. The drop arms 16A, 16B provides greater flexibility allowing the downward (or upward) pressure of the sealing member 32 to compensate for uneven floors up to 6-7 mm. If compression of one flexible section is halted, the other flexible section can still compress to allow the arm to reach its desired depth. The flexible TPE joints allow the drop arms 16A, 16B to compress and stretch to allow for uneven floor conditions.

Figure 17:
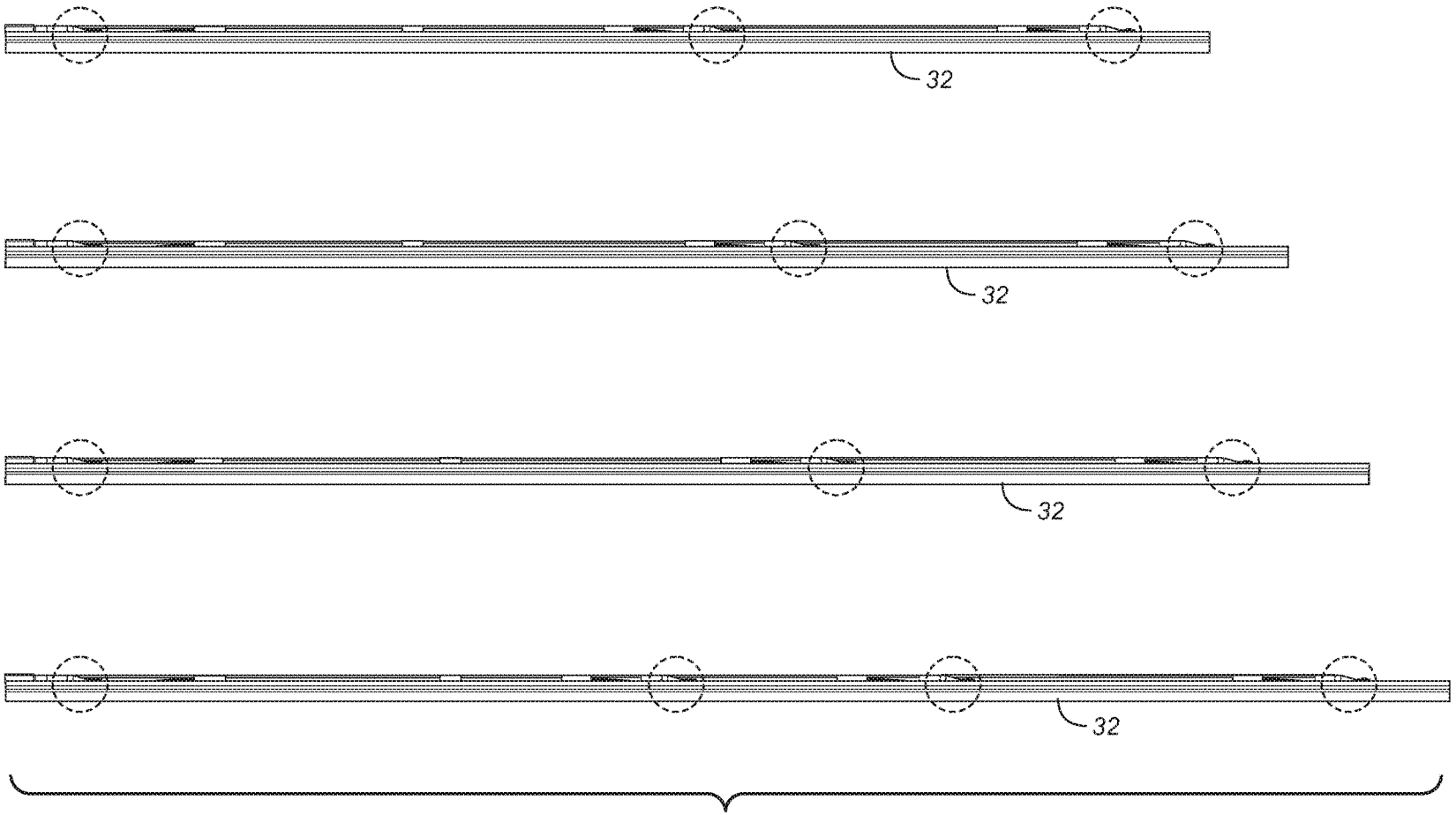
FIG. 17 illustrates four assemblies of differing lengths provided with different numbers of drop arms used (indicated by hashed circles).

Although the above embodiments have been described in terms of two drop arms, it will be appreciated that further drop arms may be used to apply the necessary pressure to longer seal assemblies resulting in the lowering of the seal member across the seal. FIG. 17 shows an example whereby four assemblies of differing lengths are provided with different numbers of drop arms used (indicated by hashed circles).

It will be appreciated that the foregoing are merely an examples of embodiments and just some examples of their use. The skilled reader will readily understand that modifications can be made thereto without departing from the true scope of the inventions.

The invention claimed is:

1. A sealing assembly for a hinged door which is pivotable over a door threshold when the door is being opened or closed, the sealing assembly comprising:

a sealing member; and a plurality of elements located within a channel which is positionable on the door adjacent an edge of the door, the elements comprising:

an actuator which mechanically moves in response to closing of the door, the actuator comprising a connector rod extending along the channel and being movable within and along the length of the channel in a first direction in response to movement of the actuator upon closing of the door and in a second direction opposite the first direction in response to opening of the door;

a drop arm comprising first, second and third rigid sections separated by first and second flexible joints, the first rigid section being connected to the connector rod, the third rigid section being connected to the sealing member, and the second rigid section being between and connected directly to the first and third rigid sections by the first and second flexible joints respectively, such that when the connector rod moves in the first direction along the length of the channel, the second rigid section pivots relative to the first rigid section about the first flexible joint and pivots relative to the third rigid section to move the third rigid section and the sealing member in a downward direction away from the channel to impart and maintain a downward vertical force on the sealing member; and a spring member connected to the sealing member and to a fixed connector block within the channel in such a way as to impart an upward force on the sealing member urging the sealing member to move into the channel in an upward direction, substantially opposite to the downward direction, when the door is opened.

2. The assembly of claim 1, wherein the spring member is a leaf spring having a substantially planar profile.

3. The assembly of claim 1, wherein each rigid section of the arm is formed of polypropylene.

4. The assembly of claim 1, wherein each flexible joint of the arm is formed of thermoplastic elastomer.

* * * * *